United States Patent [19]

Murer

[11] 4,289,438

[45] Sep. 15, 1981

[54] MACHINE FOR MECHANICALLY OPENING AND EMPTYING BAGS WHICH MAY CONTAIN A TOXIC PRODUCT

[75] Inventor: Mario V. Murer, Maurage, Belgium

[73] Assignee: Ateliers de Constructions Mecaniques Armand Colinet, Le Roeulx, Belgium

[21] Appl. No.: 9,719

[22] Filed: Feb. 5, 1979

[30] Foreign Application Priority Data

Feb. 6, 1978 [BE] Belgium ..... 0184

[51] Int. Cl.[3] ..... B65G 65/04

[52] U.S. Cl. ..... 414/412

[58] Field of Search ..... 414/412

[56] References Cited

U.S. PATENT DOCUMENTS 3,664,530 5/1972 Takiguchi ..... 414/412

4,177,726 12/1979 Kinard ..... 414/412 X

*Primary Examiner*—Robert G. Sheridan

*Attorney, Agent, or Firm*—Sughrue, Mion, Zinn, Macpeak and Seas

[57] ABSTRACT

A machine for mechanically opening and emptying bags which may contain a toxic product is described. The machine comprises a conveyor arranged so as to bring each bag toward a product hopper, severing devices adapted for severing three faces of the bag during the advancement of the bag and a gripping system for gripping the severed bag, for displacing it, for pouring the content thereof into the hopper and for bringing the empty bag to a disposal place, the machine being equipped with apparatus suitable for controlling automatically the conveyor, the severing devices and the gripping system according to a predetermined operation sequence.

5 Claims, 12 Drawing Figures

FIG. 5
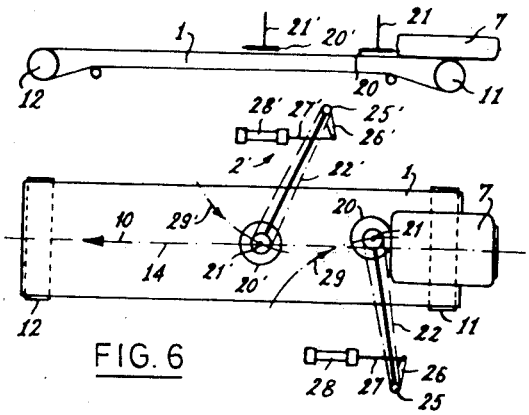
FIG. 6
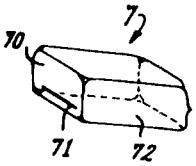
FIG. 7
FIG. 3
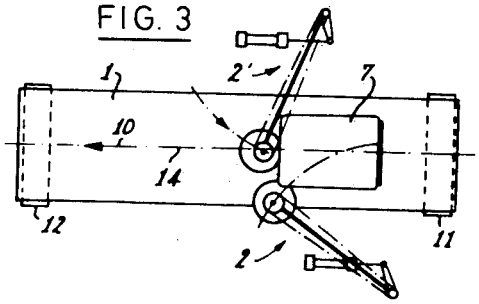
FIG. 4
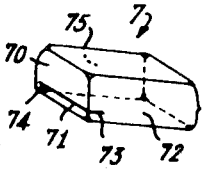
FIG. 8
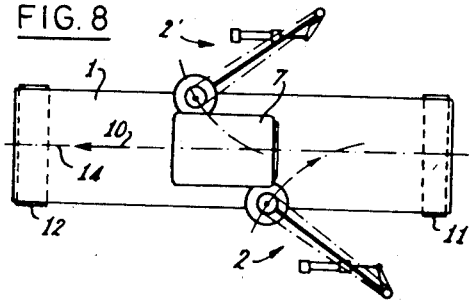
FIG. 9
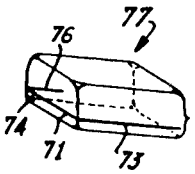

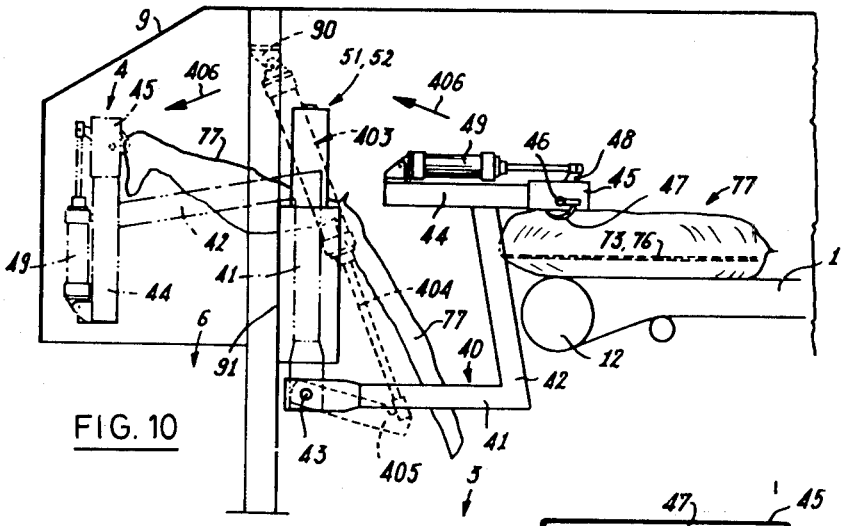
FIG. 10
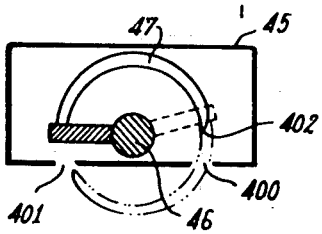
FIG. 11
FIG. 12
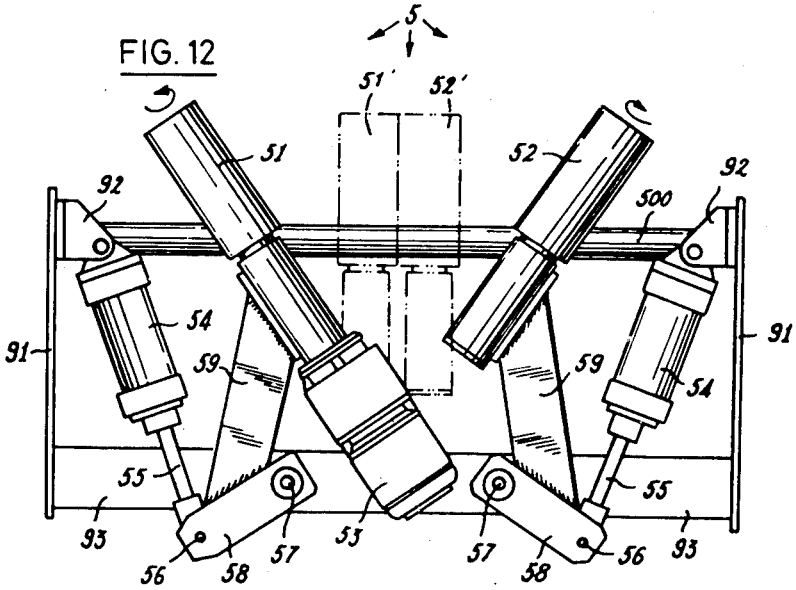

MACHINE FOR MECHANICALLY OPENING AND EMPTYING BAGS WHICH MAY CONTAIN A TOXIC PRODUCT

OBJECT OF THE INVENTION

It is known that certain industries use products supplied in bags, said bags being generally manually opened so as to bring the content thereof to the suitable stage of a production cycle. This may need an important labour or man-power which may be expensive, if a high production cadence is desired.

Sometimes, the content of the bags presents hazards for the health, due to the fact that it is dangerous to touch, absorb or inhale the product or that the radiations of the product attack the human tissues. This is true for example for corrosive products or fibrous or powdered products, such as asbestos, the dust thereof being able to cause lung cancer.

It is therefore necessary to take protection measures for the people opening the bags, but these precautions which inevitably increase the product cost are not always adequate and they generally affect the industrial yield.

It is an object of the invention to obtain a good production cadence with a reduced man-power, without affecting the health, even if the content of the bags is toxic, by mechanically opening and emptying the bags near the place where the product is to be used.

This invention relates therefore to a machine for mechanically opening and emptying bags which may contain a toxic product.

BRIEF DESCRIPTION OF THE INVENTION

The machine according to this invention comprises a conveyor arranged so as to bring each bag toward a product hopper, severing means adapted for severing three faces of the bag during the advancement of said bag and a gripping system for gripping the severed bag, for displacing it, for pouring the content thereof into the hopper and for bringing the empty bag at a disposal place, the machine being possibly equipped with means suitable for controlling automatically the conveyor, the severing means and the gripping system according to a predetermined operation sequence.

DETAILED DESCRIPTION OF THE INVENTION

The machine may also comprise means for the removal of emptied bags.

The machine may be located in an enclosure and a depression or vacuum may be created in said enclosure.

The severing means for severing three faces of a bag comprise two severing or cutting elements having a vertical axis and each carried at one end of an arm, the other end of which is hinged to a restraining system adapted to permanently bring the cutting element back to the axis of the conveyor, the elements of the restraining means being respectively fixed on the left and on the right of the conveyor, so that the first cutting element which contacts a bag cuts, in one pass, part of the front face of the bag and a side face thereof, the second severing element cutting thereafter the remaining part of the front face and the other side face of the bag.

The severing or cutting elements consist preferably of rotating discs; they may also consist of fixed knives or any other equivalent means.

The gripping system comprises a movable support and a gripping means selected among those having a hooking, suction and pinching function and, when the severed bag is fixed to said gripping system, the displacement of the support causes the bag to be spread out on a distance equal to two times its length above the product hopper. The gripping system may be movable in a horizontal plane.

The gripping system is preferaby movable in a vertical plane. This system comprises a casing which carries rotating gripping hooks and is rigidly connected with two arms adapted to pivot around an axis, so that, when the hooks have been inserted into the upper part of a severed bag, the rotation of the arms causes the bag to be spread out above the hopper, so as to empty it and to bring the emptied bag to the disposal place thereof.

The machine according to the invention preferably comprises, for avoiding the accidental fall into the hopper of severed bags and severed bag parts, in addition to the conveyor, to two severing or cutting means and to a movable gripping system, driving means, positioned on the path of the emptied bag and suspended to the casing of the gripping system, said driving means comprising two rollers arranged in a V shaped position and adapted so as to become closer to each other and to start rotating so as to pinch the emptied bag and to send it to the disposal place, particularly when the emptied bag has become free from the gripping system.

DRAWINGS

The attached drawings show by way of example an embodiment of the invention. In said drawings:

FIGS. 1 and 2 are respectively side and front views of the whole of the machine;

FIGS. 3 to 9 illustrate the operation of the severing or cutting means;

FIGS. 10 and 11 show respectively the operation of the gripping system and a detail thereof, and FIG. 12 shows the arrangement of the parts of the means for driving away the emptied bags.

DESCRIPTION OF THE DRAWINGS

The machine for opening and emptying bags according to the invention comprises a bag conveyor 1, two bag severing or cutting means 2, 2', a product hopper 3, a system 4 for gripping severed bags, driving means 5 for the severed bags and a disposal place 6 for the emptied bags. The machine comprises moreover means suitable for automatically controlling the movable parts being not shown on the attached drawings.

Reference 7 represents the closed bags containing a product to be poured into the hopper 3, whereas reference 8 denotes any means for bringing bags to the machine, the latter means being, for example, a common conveyor. The machine is enclosed in an enclosure 9 which may be submitted to a vacuum, in order to avoid the outside dispersion of dusts. It is however to be noted that the machine must not necessarily be located in an enclosure if it is desired to work in open air. In the latter case, a suction or aspirating device is sufficient when the opening and emptying of the bags cause the release of dusts.

Figure 1:
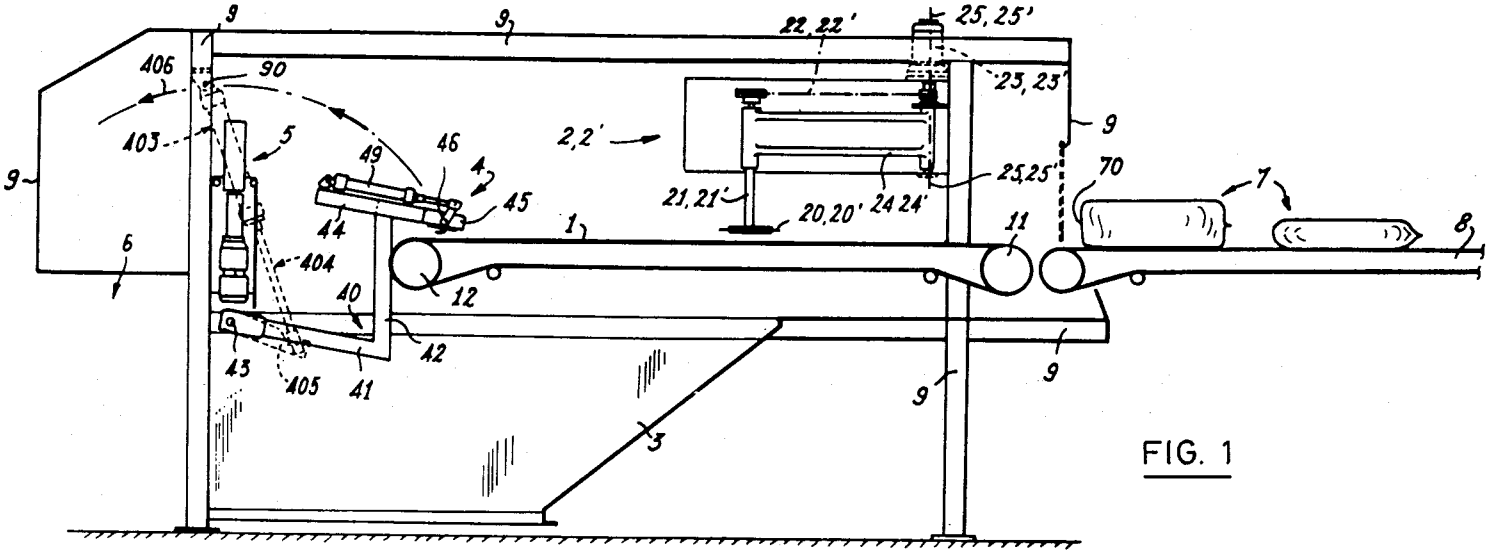
Figure 2:
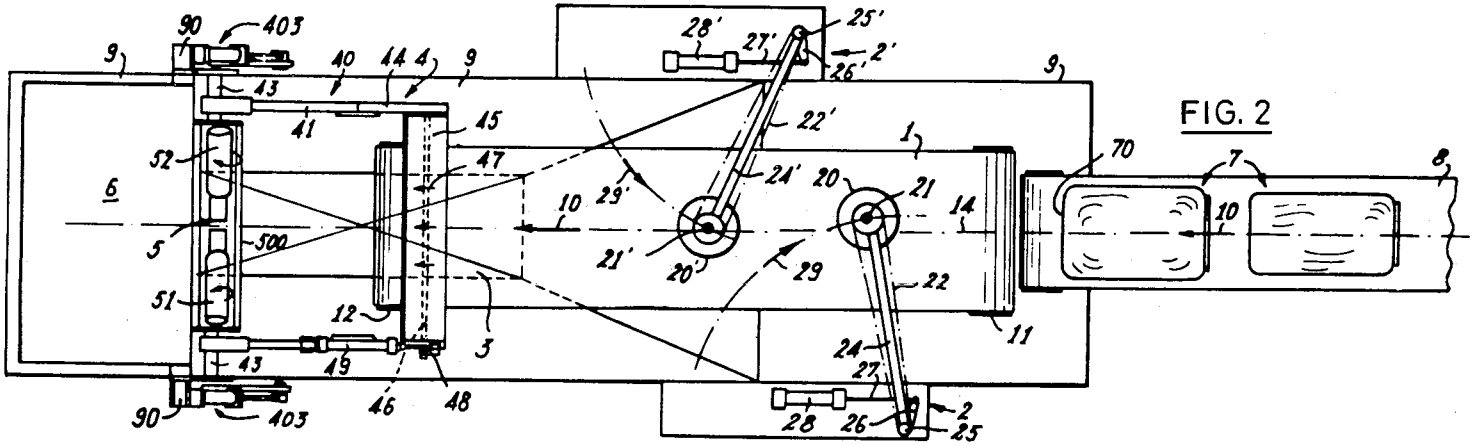

The conveyor 1 (schematically shown in FIGS. 1 and 2) is used for advancing the bags 7 without shocks, in the direction of arrow 10, between two barrels or drums 11 (inlet of enclosure 9) and 12 (product hopper 3), one of which may be rotatively driven.

Each severing or cutting means 2, 2' comprises a movable cutting element above the conveyor 1 and a restraining system adapted for constantly urging the cutting element toward the axis 14 of the conveyor.

Each cutting element is a rotating disc 20, 20' having a vertical axis 21, 21' which may be rotated by a belt 22, 22' passing on the shaft of a motor 23, 23'. The vertical axis 21, 21' is carried by a pivoting arm 24, 24' hinged to a fixed axis 25, 25' carrying also a link or crank arm 26, 26' hinged to the free end of a rod or shaft 27, 27' of a jack 28, 28' which is preferably a pneumatic jack. In the represented embodiment, the fixed axis 25, 25' for the pivoting motion of arm 24, 24' is coaxial to the axis of motor 23, 23'.

The jacks 28, 28' are respectively located on the left and on the right of the conveyor.

When the jacks are extended, the rotating discs 20, 20' are located thus one after the other at right angles with said axis. The height of the discs is adjusted so that they are exactly at the same level. The restraining means is also adjusted so that the force (arrow 29, 29') exerted by it be lower than the longitudinal or rotation sliding force of the bag on the conveyor.

A first bag 7 carried by the conveyor 1 contacts the first rotating disc 20 at a place which is nearly in the middle of the front face 70 of the bag, the thrust exerted by the bag on said disc maintaining a permanent contact therebetween (FIGS. 3 and 4). While the bag is advancing, the rotating disc cuts a line 71 in said face 70 (FIG. 4). During the advancement of the conveyor, the bag pushes back the disc, which resists to the pushing force under the influence of the restraining means, the arm 24 is caused to pivot toward the edge of the conveyor, while remaining in contact with the bag and the disc 20 acts then on the side face 72 and cuts a line 73 therein (FIGS. 8 and 9). When the disc is no more in contact with the bag, due to the forward movement of the latter, said disc comes back to its initial position perpendicularly to the axis 14 of the conveyor, so as to allow the cutting of the following bag.

The jack 28' is fixed to the severing means 2' at the other edge of the conveyor with respect to jack 28 of the severing means 2, at such a distance that the rotating disc 20' acts on the front face 70 of the bag 7 at the moment where disc 20 starts cutting the side face 72 (FIG. 4). The disc 20' inserted in the first part of the severed line or slot 74 previously created by disc 20 cuts now a line or slot 74, so that the front face 70 is completely severed (FIG. 4).

While the conveyor advances, the arm 24' pivots around the bag (FIG. 8), acts on the other side face 75 and severes it along a line 76, so that three faces of the bag have been cut, when the contact between the bag and the disc is interrupted (FIG. 9); the so-severed bag is represented by reference 77 in FIG. 10.

The pneumatic jacks 28, 28' are connected to a compressed air source (not shown) which applies an adjusted pressure to the bodies of said jacks 28, 28'.

By means of a controlling or operating device, the movement of the conveyor 1 may be stopped, when the forward part of the severed bag 77 is in front of the barrel or drum 12 (FIG. 10) before the opening of the hopper 3 and the operation of the gripping system 4 may then be started.

The gripping system 4 comprises two L-shaped parallel arms (FIGS. 1, 2 and 10), the legs 41 and 42 of which are hinged around an axis or shaft 43 fixed to the enclosure 9; the upper legs 42 carry, at their end, two beams 44 which support a casing 45 crossed by a shaft 46 provided with rotating hooks 47 for gripping the severed bags. The shaft 46 is connected by means of a link 48 to the rod of a jack 49, which is preferably a pneumatic jack, fixed to one of the posts 44 and openings 400 and 401 are provided in the bottom of the casing 45 (FIG. 11) on the path of the rotating hooks 47. When the jack 49 is retracted, the hooks 47 are also retracted, i.e. the pointed ends 402 thereof are inside the casing 45.

When the casing 45 is located toward the downstream end of a severed bag 77 and when the jack 49 is extended, the link 48, hinged around the shaft 46, causes the clockwise rotation of this shaft, so that the ends 402 project through the openings 400, pass once through the bag 77 and pass again through the bag in front of opening 401 and return into the casing 45. The back is thus perforated two times by the same hook 47 and this security gripping avoids any unhooking of the bag during its movement toward the disposal place 6, the bag being emptied into the hopper during this operation.

On the outside of the enclosure 9 (FIGS. 1, 2 and 10) a jack 403, preferably of the pneumatic type, is mounted on both sides of said enclosure 9, the bottom of said jacks being suspended to a fixed point 90, whereas its rod 404 is fixed to a lever 405 hinged around an axis 43 to which the L-shaped arms 40 are connected. The operation of the jacks 403 allows a movement of the gripping system on a quarter of a circle path above the hopper 3.

Driving means 5 (FIGS. 1, 2, 10 and 12) are used for assisting the displacement of the several bags toward the disposal 6 of emptied bags and mainly for avoiding an accidental fall of bags and bag parts into the hopper.

Said driving means, which are attached to fixed vertical posts 91, comprise, on the one hand, two rollers 51 and 52, one of which may permanently be rotated by an electric motor 53 and, on the other hand, two jacks 54, preferably pneumatic jacks, each suspended through its bottom to a fixed support 92 fixedly attached to post 91 and the rod 55 of which acts, through a hinge 56 and a pivot 57 of an angle lever 58, 59 which is itself fixed to one of the rollers 51 and 52, the pivot 57 of each angle lever being arranged on a cross-bar 93 fixed between the vertical posts 91; the driving means comprise moreover two free rollers 500 which are parallel to the support 93.

In the extended position of the jacks 54 shown on the drawings (FIG. 12), the axes 25 of the rollers 51, 52 form an angle V in a vertical plane; when retracting the jacks, on the contrary, the links 58 are removed from each other, so that finally a position 51', 52' is obtained, wherein the rollers tend to contact each other, the already rotating roller 51' driving roller 52' in the reverse direction.

As already disclosed, the arrival of the forward part of a severed bag 77 at the barrel 12 (FIG. 10) causes the conveyor 1 to stop. At this moment, rollers 51, 52 of the driving means 5 are separated as a V and the gripping system 4 is stopped in vertical position above the disposal place 6, the hooks 47 being retracted into the casing 45.

The stop of conveyor 1 causes the extension of the jacks 403 (FIG. 10); the gripping system 4 moves in the direction opposite to curved arrows 406 and places the casing 45 on the severed bag 77 stopped on the conveyor.

The stop of the jacks 403 controls the extension of jack 49, so that the hooks 47, the number of which is preferably of 3 to 5, go out through the openings 400 and enter again into the casing through the openings 401, after having pierced two times the upper part of the bag 77 (FIGS. 10 and 11). The complete extension of the jack 49 which has permitted the gripping, causes the reaction of the jacks 403 and simultaneously or substantially simultaneously the re-starting of conveyor 1.

Under these circumstances, the gripping system 4 raises the bag 77 by means of the hooks 47, whereas the bag is moved toward the opening of the hopper 3. The emptying of the bag thus starts and is completed when the bag is developed or spread out on two times its length during the rotation.

During the movement, the emptied bag passes through the driving rollers which come closer together when the bag is sufficiently engaged (FIGS. 10 and 12), the retraction of the jacks 54 being caused by the impulse of a (not shown) stroke-end device; at this moment, the hooks 47 retract inside the casing, so as to release the bag 77.

The rollers 51', 52' pressed against the emptied bag draw the bag toward the disposal opening 6; the free rollers 500 located respectively before and behind the rollers 51', 52' assist the passage. When the emptied bag falls through the opening 6, the rollers 51', 52' move away from each other and the machine is ready for emptying the next bag.

At the emptying stage of the severed bags, it is possible to place a brusking or shaking system, taking into account the product to be handled.

Moreover, it is also possible to add a product scraping system for directing toward the hopper 3 the product which would escape from bags 7, during their displacement from the outer conveyor 8 to conveyor 1.

The invention is obviously not limited to the embodiment which has been described and is represented by way of example, many modifications being possible therein within the scope of the invention. For example, for causing the successive movements of the machine to be continuous, it is possible to use controlling and detection means, such as feeling means, photoelectric cells or infrared cells, stroke-end switches, balances, shutters and the like. Of course, the machine can also be manually controlled. Finally, the invention is of course not limited to the use of pneumatic jacks, these jacks being replacable by mechanical, hydraulic or other means.

What we claim is:

1. A machine for mechanically opening and emptying bags which may contain a toxic product, comprising:

(a) a conveyor arranged to bring bags placed on it to a hopper for collecting the products contained in the bags, (b) severing means adapted for severing the front face and the two lateral faces of a bag carried by the conveyor during the advancement of the latter, without severing totally the back face of the bag, and (c) pivoting arms disposed for pivotal movement about a fixed axis, said pivotal arms having a gripping means affixed thereto, said pivotal arms being movable between a first position wherein said gripping means grips a top portion of said severed bag when said bag is full, and a second position wherein said bag is detached after being emptied, the movement of said pivotal arms from said first position to said second position spreading said severed bag to an amount approximating two times the length of said bag, while said bag is supported upon said conveyor, said bag remaining supported by said conveyor as the products contained in said bag are emptied into said hopper.

2. A machine according to claim 1, said gripping means in said first position being positioned over the full severed bag in order to grip the top portion thereof when said conveyor is stopped, said gripping means when moving toward said second position folding back said top portion of the bag in order to pour the contents thereof into said hopper when said conveyor is again started, the force exerted on said bag by said gripping means being incapable of tearing the unfolded bag when the bag is emptied into said hopper.

3. A machine according to claim 1, wherein the gripping means are movable in a vertical plane by said pivoting arms, and includes an element rigidly connected with said pivoting arms and carrying pivoting gripping hooks, such that, when the hooks have been inserted into the top portion of a severed bag, the pivoting of said arms causes the bag to be spread out and to be moved, together with said gripping means, towards the second position wherein the hooks are extracted from the bag and the latter is dropped into a disposal place of the emptied bags, after the content of said bag has been poured into the product hopper by the combined action of the gripping means and the conveyor.

4. A machine according to claim 1, wherein said gripping means are movable in a vertical plane by said pivoting arms and comprise an element rigidly connected with said pivoting arms and carrying pivoting gripping hooks of a shape such that they can each grip the top portion of a severed bag by piercing it two times, so that, when the hooks have been inserted into the top portion of a severed bag, the pivoting of said arms causes the bag to be spread out and to be moved, together with said gripping means, towards the second position, in which the hooks are extracted from said bag and the latter is dropped into a disposal place of the emptied bags, after the content of said bag has been poured into the product hopper by the combined action of the gripping means and the conveyor.

5. A machine according to claim 1, further comprising driving means which are positioned in the path of an emptied bag and are suspended from the gripping means, said driving means comprising two rollers arranged in a V-shaped manner and adapted to be movable in order to become proximate to one other and to rotate, so as to pinch the emptied bag and to transport it to the disposal place, when the emptied bag has become free from the gripping means, said driving means preventing the accidental fall of severed bags or bag parts into the product collecting hopper.

* * * * *